US006699024B2

(12) United States Patent
Dong

(10) Patent No.: US 6,699,024 B2
(45) Date of Patent: Mar. 2, 2004

(54) HYDRAULIC MOTOR

(75) Inventor: Xingen Dong, Greeneville, TN (US)

(73) Assignee: Parker Hannifin Corporation, Cleveland, OH (US)

( * ) Notice: Subject to any disclaimer, the term of this patent is extended or adjusted under 35 U.S.C. 154(b) by 0 days.

(21) Appl. No.: 10/174,593

(22) Filed: Jun. 19, 2002

(65) Prior Publication Data

US 2003/0003007 A1 Jan. 2, 2003

Related U.S. Application Data

(60) Provisional application No. 60/302,257, filed on Jun. 29, 2001.

(51) Int. Cl.[7] ..... F03C 2/08
(52) U.S. Cl. ..... 418/61.3
(58) Field of Search ..... 418/61.3

(56) References Cited

U.S. PATENT DOCUMENTS

| | | | | | |
|---|---|---|---|---|---|
| 2,984,223 | A | | 5/1961 | Budzich | 121/121 |
| 3,289,601 | A | | 12/1966 | Compton | 103/130 |
| 3,316,814 | A | * | 5/1967 | Charlson | 418/61.3 |
| 3,572,983 | A | | 3/1971 | McDermott | 418/61.3 |
| 3,680,987 | A | | 8/1972 | Ohrberg | 418/61.3 |
| 3,687,578 | A | | 8/1972 | White, Jr. et al. | 418/21 |
| 3,825,376 | A | * | 7/1974 | Petersen et al. | 418/61.3 |
| 3,862,814 | A | * | 1/1975 | Swedberg | 418/61.3 |
| 3,863,449 | A | | 2/1975 | White, Jr. | 60/456 |
| 3,899,270 | A | | 8/1975 | Swedberg | 418/61.3 |
| 4,298,318 | A | | 11/1981 | Tsuchiya et al. | 418/61.3 |
| 4,380,420 | A | | 4/1983 | Wüsthof et al. | 418/61.3 |
| 4,411,606 | A | * | 10/1983 | Miller | 418/61.3 |
| 4,411,607 | A | | 10/1983 | Wüsthof et al. | 418/61.3 |
| 4,462,773 | A | | 7/1984 | Erasov et al. | 418/61.3 |
| 4,545,748 | A | | 10/1985 | Middlekauff | 418/61.3 |
| 4,563,136 | A | | 1/1986 | Gervais et al. | 418/1 |
| 4,586,885 | A | | 5/1986 | Middlekauff | 418/61 B |
| 4,657,494 | A | | 4/1987 | Erasov | 418/61.3 |
| 4,666,382 | A | | 5/1987 | Eisenmann | 418/61.3 |
| 4,877,383 | A | * | 10/1989 | White, Jr. | 418/61.3 |
| 4,976,594 | A | | 12/1990 | Bernstrom | 418/61.3 |
| 4,981,423 | A | | 1/1991 | Bissonnette | 418/61.3 |
| 5,061,160 | A | | 10/1991 | Kinder et al. | 418/61.3 |
| 6,071,102 | A | * | 6/2000 | Hjelsand | 418/61.3 |
| 6,155,808 | A | * | 12/2000 | White | 418/61.3 |
| 6,257,853 | B1 | * | 7/2001 | White | 418/61.3 |

FOREIGN PATENT DOCUMENTS

| | | | | |
|---|---|---|---|---|
| JP | 54-17505 | * | 2/1979 | 418/61.3 |

OTHER PUBLICATIONS

Parker Hydraulics, "Torqlink Service Procedure," May 31, 2000.

* cited by examiner

*Primary Examiner*—John J. Vrablik
(74) *Attorney, Agent, or Firm*—Renner, Otto, Boisselle & Sklar LLP

(57) ABSTRACT

A hydraulic motor 10/110/210 has an end cover 12/112/212 including a first port 14/114/214 and a second port 16/116/216, and a gerotor drive assembly 18/118/218 which hypocycloidally moves a drive link 22/122/222. The motor's flow circuit comprises a working path (e.g., for providing rotational motion) from the end cover 12/112/212, through the drive assembly 18/118/218 and back to the end cover 12/112/212. Bolts 26/126/226 extend through registered openings in the end cover 12/112/212, the drive assembly 18/118/218 and a housing 20/120/220 and the bolts 26/126/226 are positioned in a circular array outside the motor's pressure vessel whereby the motor 10/110/210 has a "dry bolt" design. The motor's flow circuit can also comprises a non-working path (for cooling, lubrication and/or sealing purposes) which circulates fluid through chambers surrounding the drive train components.

15 Claims, 10 Drawing Sheets

HYDRAULIC MOTOR

RELATED APPLICATION

This application claims priority under 35 U.S.C. §119(e) to U.S. Provisional Patent Application No. 60/302,257 filed on Jun. 29, 2001. The entire disclosure of this provisional application is hereby incorporated by reference.

FIELD OF THE INVENTION

The present invention relates generally as indicated to a hydraulic motor and, more particularly, to a hydraulic motor with a gerotor drive assembly which provides rotational motion to a desired piece of machinery.

BACKGROUND OF THE INVENTION

A hydraulic motor is a converter of pressurized oil flow into torque and speed for transferring rotational motion to a desired piece of machinery. Of particular relevance to the present invention is a hydraulic motor, wherein this conversion is accomplished by a drive assembly having a gerotor set. A gerotor motor can provide a combination of compact size, low manufacturing cost, and high torque capacity, thereby making it a very popular choice for heavy duty applications requiring low speeds (e.g., 1000 rpm or less) and high torques (e.g., 15,000 In-Lb or more).

A gerotor set comprises an outer stator and an inner rotor having different centers with a fixed eccentricity. The stator has internal teeth or "vanes" which form circular arcs, and the inner rotor has one less external "teeth" or lobes. The rotor lobes remain in contact with the circular arcs as the rotor moves relative to the stator, and these continuous multi-location contacts create fluid pockets which sequentially expand and contract. As fluid is supplied and exhausted from the fluid pockets in a timed relationship, the rotor moves hypocycloidally (i.e., orbits and rotates) relative to the stator.

A drive link is interconnected to the rotor for movement therewith, and this interconnection usually constitutes crowned external splines on the drive link which engage with internal splines on the rotor. Such a splined mating arrangement allows the drive link to "wobble" during operation of the motor. To prevent the drive link from slipping axially backward out of the splined engagement, an axial stop can be provided adjacent the rear end (or nose portion) of the drive link.

The drive assembly of a gerotor motor will typically include a valving system to supply and exhaust the fluid from the gerotor pockets in the desired timed relationship. One common type of valving system includes a disk-type commutator and a stationary valve member (e.g., a manifold). A slow-speed commutator rotates at the speed of rotation of the rotor, and manifold channels are opened/closed in the angular circumferential direction using edges of the valve openings. A fast-speed commutator orbits with the rotor and the commutator's inner diameter and outer diameter control fluid metering. Generally, a fast-speed commutator is preferred because it allows valving to be synchronized with the volume changes of the gerotor fluid pockets (rather than rotation of the shaft), thereby significantly reducing timing errors.

The use of a commutator creates the potential for cross-port leakage (e.g., flow bypasses the drive assembly) at the interface between the commutator and an end cover. To prevent such cross-port leakage, a groove can be formed in the back axial face of the commutator and a triangular or trapezoidal (in cross-section) sealing ring positioned therein. The sealing ring is usually oversized (e.g., the height of the ring is greater than the depth of the groove) so that, when the motor is at rest, the ring projects outwardly from the groove. Upon start-up of the motor, the hydraulic imbalance pushes the sealing ring out of the groove to perform the sealing at the interface between the commutator and end cover.

The drive link is interconnected to a shaft to transfer rotational movement thereto. For example, the motor can include a coupling shaft which is connected to the drive link (e.g., by a splined interconnection) and which can be coupled to the input shaft of the desired piece of machinery. In this case, the drive assembly (e.g., the commutator, the manifold and the gerotor set) is commonly positioned between the motor's end cover and a housing which rotatably supports the coupling shaft. Alternatively, the shaft can be part of the gearbox of the desired machinery and the drive link is directly coupled thereto. In this case, the drive assembly is commonly positioned between the motor's end cover and a mountable housing for attachment to the gearbox. In either case, a plurality of bolts extend through registered openings in the end cover, the drive assembly and the housing to clamp these components together. A wear plate can be positioned between the drive assembly and the housing, and the clamping bolts can also extend therethrough. Face seals are provided between the various components to prevent leakage at the interfaces.

A hydraulic motor will have a flow circuit which determines the path of fluid flow and can be viewed as defining a cylindrical pressure vessel. The diameter of the pressure vessel is determined by the outermost radial reach of the fluid circuit, and the length of the pressure vessel is determined by the longest axial reach of the fluid circuit.

The flow circuit of a hydraulic motor includes a working path which extends between the inlet port and the outlet port and through which the fluid passes to cause the drive assembly to rotate the output shaft in the appropriate direction. When the motor is operating in a first direction, the first port is the inlet port and the second port is the outlet port and the output shaft rotates in a first direction (e.g., clockwise). When the motor is operating in a second direction, the second port is the inlet port and the first port is the outlet port and the output shaft rotates in a second direction (e.g., counterclockwise). In either case, the inlet port can be connected to a pump discharge and the outlet port can be connected to a return line to a reservoir which feeds the pump suction.

In most hydraulic motor designs, the working path extends through non-working portions of the motor (e.g., the housing and/or an axial passageway in the drive link), whereby the length of the working path extends for a substantial distance of the pressure vessel. Also, most hydraulic motors have a "wet bolt" design, wherein the clamping-bolt openings double as fluid passageways and face seals are located radially outside the diameter of the circular array of clamping bolts. This arrangement results in the diameter of the pressure vessel occupying a substantial portion of the motor's radial dimension, and requires the clamping bolts to directly absorb corresponding forces.

The flow circuit of a hydraulic motor will usually also include a non-working path, including chambers surrounding the drive train components (i.e., the drive link and the coupling shaft) and through which fluid passes for cooling and lubrication of these components. In a two-pressure-zone motor design, fluid traveling through the non-working path rejoins fluid traveling through the working path somewhere upstream of the outlet port. In a three-pressure-zone motor design, fluid traveling through the non-working path does not rejoin the working path and exits the motor through a separate case drain in the housing.

A three-pressure-zone motor design is used in applications where contamination flushing must be performed. Additionally or alternatively, a three-pressure-zone design is used for applications in which the drive link is coupled directly to the input shaft of a gearbox. Otherwise, a two-pressure-zone motor design usually is employed because it simplifies plumbing criteria, reduces reservoir size requirements, decreases pump capacity demands, and minimizes the risk of "dead zones" within the motor.

Some of the most significant considerations when selecting a hydraulic motor, especially for heavy-duty applications, include the motor's no-load pressure drop (or mechanical efficiency), its life expectancy, its start-up (or breakaway) efficiency, and/or its torque capacity. Accordingly, motor manufacturers are constantly trying to improve upon these performance parameters.

SUMMARY OF THE INVENTION

The present invention provides a hydraulic motor which, when compared to conventional hydraulic motors, can be constructed to have an improved no-load pressure drop, a longer life expectancy, a better start-up efficiency and/or a higher torque capacity. The motor can be especially well suited for heavy-duty applications requiring low speeds and high torques.

More particularly, the present invention provides a hydraulic motor comprising an end cover, a drive link, a drive assembly, and a flow circuit extending between a first port and a second port. The flow circuit comprises a working path through which fluid flows to cause the drive assembly to hypocycloidally move the drive link in a first direction when the first port is the inlet port and in a second direction when the second port is the inlet port. When the motor is operating in a first direction, the fluid flows in a first direction through the working path of the fluid circuit and, when the motor is operating in a second direction, the fluid flows in a second direction through the working path of the fluid circuit. The motor can be designed to operate in only one direction (either the first or the second) or can be designed to operate in both directions. The flow circuit can also comprise a non-working path passing through chambers surrounding the drive link to cool and lubricate the drive train components.

According to one aspect of the invention, the first port and the second port are part of the end cover, and the working path is axially confined to a length between the end cover and the drive assembly. As such, the working fluid is not subjected to no-load pressure drops from unnecessary travel through non-working portions of the motor. This confinement of the working path results in a significantly reduced pressure drop (e.g., 50% less) when compared to conventional hydraulic motors of similar size and/or capacity and this translates into a dramatic improvement in motor efficiency.

According to another aspect of the invention, the clamping bolts are radially positioned outside of the motor's pressure vessel and, in any event, they do not communicate with any of the motor's fluid chambers. This radially outward positioning of the clamping bolts, or "dry bolt" design, results in less axial tensile stress per bolt for a motor design having a given number of clamping bolts. Additionally or alternatively, because fluid flow characteristics do not play a part in bolt placement, more clamping bolts can be used in a given motor design. Less strain-per-bolt and/or more bolts-per-motor result in less bolt-stretching and equal bi-directional motor performance which, in turn, results in a longer motor life. Furthermore, this "dry bolt" design avoids the extra manufacturing cost of countersink machining which is required in a "wet bolt" design.

According to another aspect of the invention, a non-interference seal arrangement is used at the valving interface between the end cover and the drive assembly. In this arrangement, a sealing ring is positioned in a groove in the commutator. The height of the sealing ring is less than the depth of the groove, whereby the seal does not project outwardly from the groove when the motor is at rest. Also, the groove and seal can each have a roughly rectangular cross-sectional shape such that the ring resides loosely within the groove when the motor is at rest and then, upon start-up of the motor, is appropriately moved to a position which prevents cross-port leakage. Specifically, the seal is pushed rearward by hydraulic imbalance forces and is pushed in the appropriate radial direction by the port-to-port pressure differential. With an oversized seal, mechanical friction is created between the seal and the end cover during startup or very slow speed operation (e.g., 10 rpm or less). With the sealing arrangement of the present invention, this mechanical friction is eliminated thereby enhancing start-up and low speed efficiency and increasing the life of the sealing ring.

According to a further aspect of the invention, an axial stop for the drive link is mounted on a moving part of the drive assembly and, more particularly, is preassembled on an internal diameter of the rotor. When the axial stop is mounted on a stationary component of the motor (e.g., the end cover), the drive link will rotate/orbit relative to the axial stop, thereby creating internal mechanical friction therebetween. However, with the axial stop system of the present invention, this internal friction is eliminated, thereby improving the motor's startup efficiency.

According to a further aspect of the invention, the drive link has an axial passageway which allows a component of the drive train (e.g., a coupling shaft) to centrifugally pump a diverted portion of fluid from the working path through the non-working path. Regardless of whether the motor is operating in the first direction or the second direction, the diverted portion of the fluid is centrifugally pumped through the non-working path in the same direction by the output shaft. When the motor is operating in the first direction, the non-working portion of the fluid is diverted from the high pressure (pre-working) fluid and, when the motor is operating in the second direction, the non-working portion of the fluid is diverted from the low pressure (post-worked) fluid. This non-working path is believed to provide superior lubrication for the splined interconnection between the drive link and the rotor and/or the splined interconnection between the drive link and the output shaft. Since, in general, the torque capacity of a motor is limited by the condition of its drive train components, this superior lubrication arrangement can greatly enhance the performance of a motor. This aspect of the invention finds particular application in two-pressure-zone motor designs but can also be used in three-pressure-zone motor designs as well.

These and other features of the invention are fully described and particularly pointed out in the claims. The following description and drawings set forth in detail certain illustrative embodiments of the invention, these embodiments being indicative of but a few of the various ways in which the principles of the invention may be employed.

DRAWINGS

DETAILED DESCRIPTION

Figure 1:
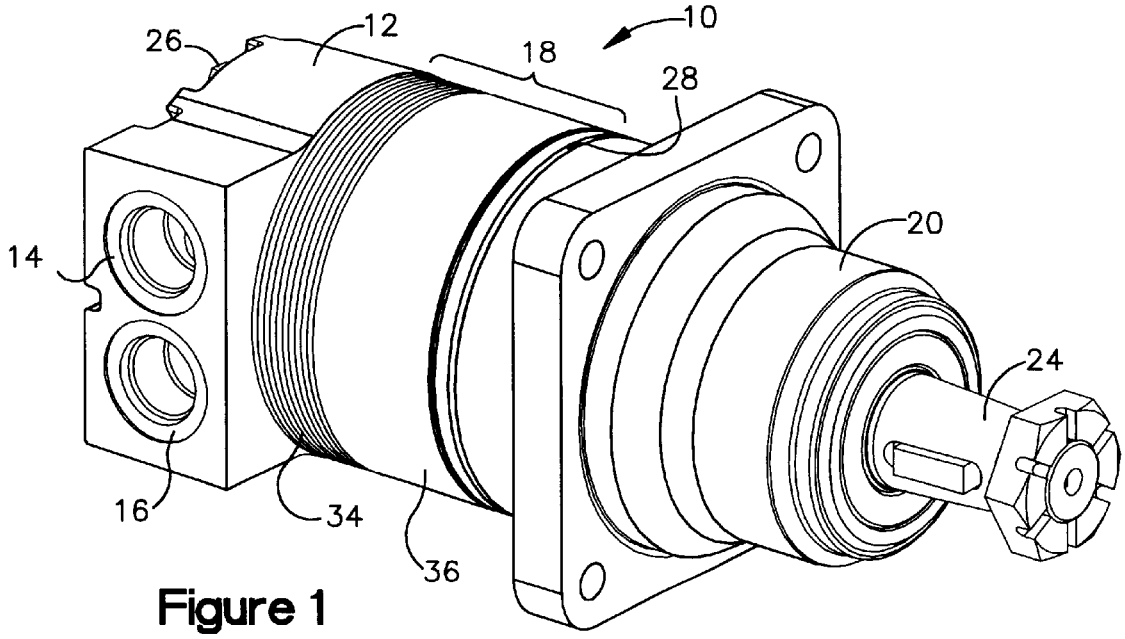
FIG. 1 is a perspective view of a hydraulic motor 10 according to the present invention.
Figure 2:
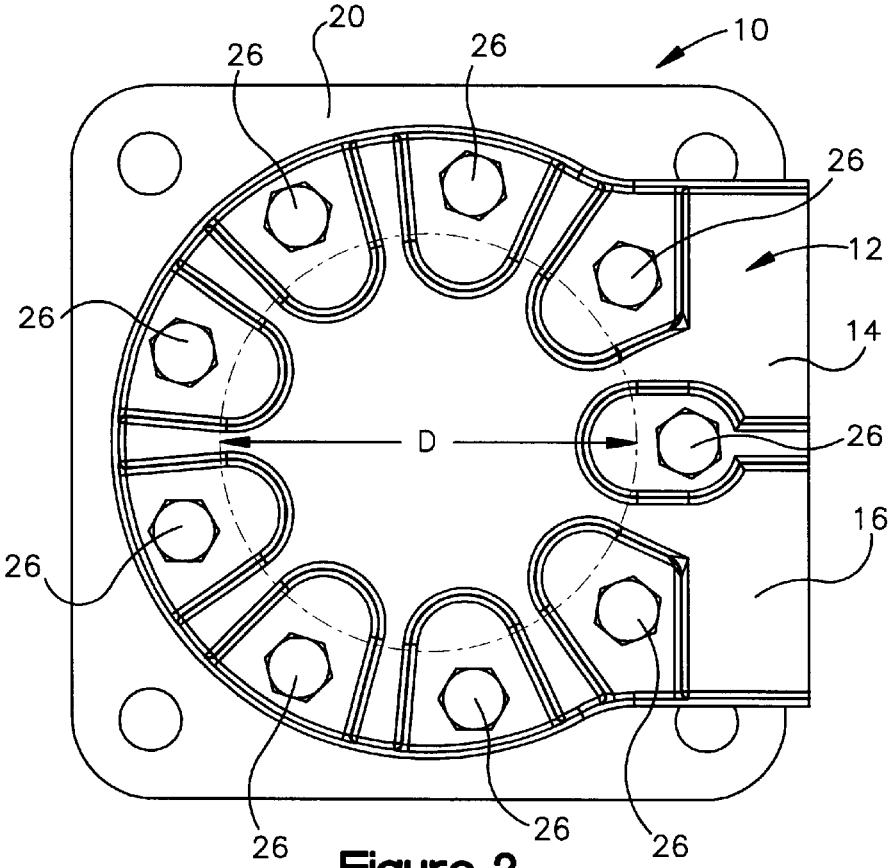
FIG. 2 is an end view of the hydraulic motor 10.
Figure 3:
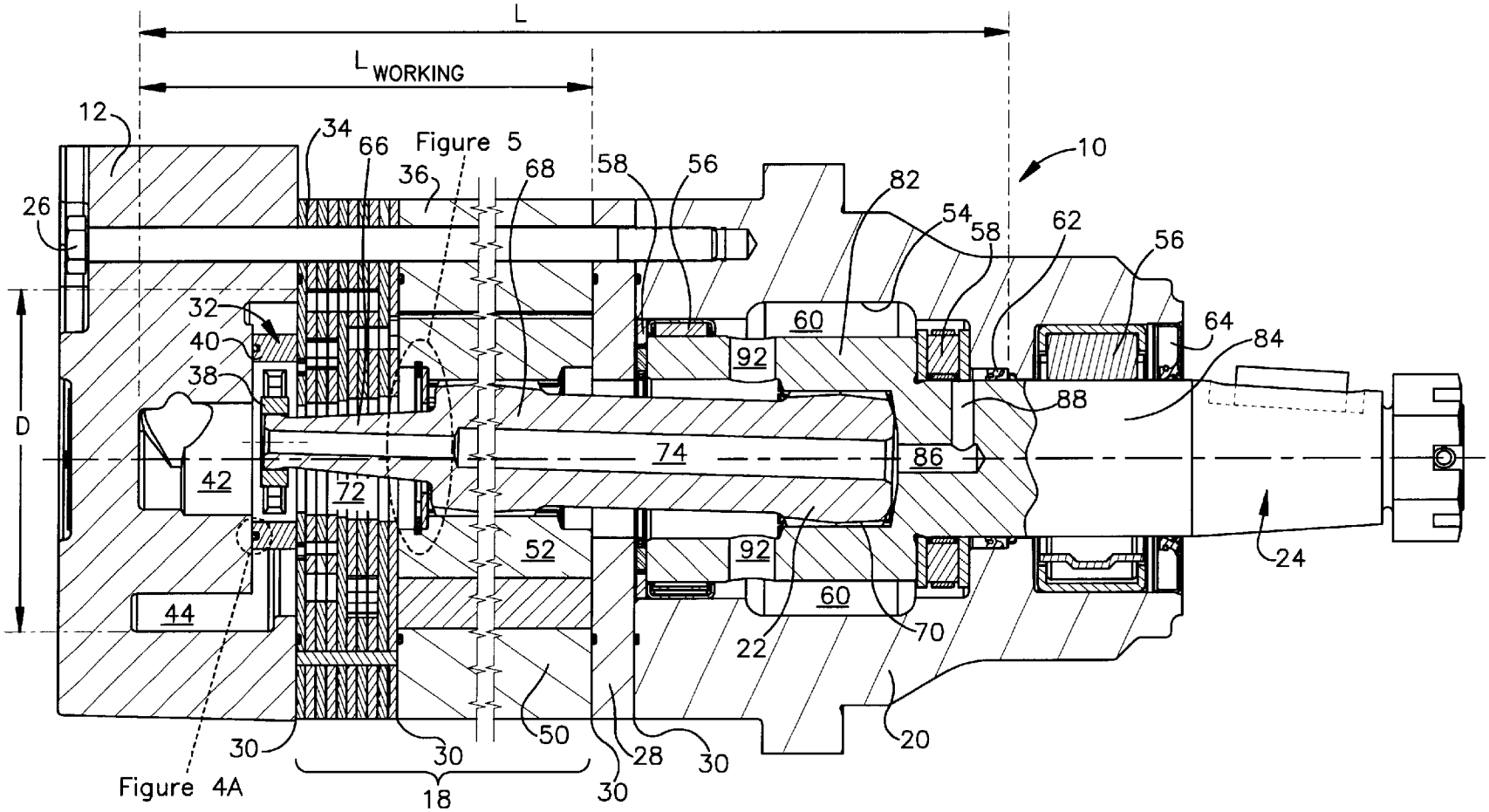
FIG. 3 is a sectional view of the hydraulic motor 10.

Referring now to the drawings, and initially to FIGS. 1–3, a hydraulic motor 10 according to the present invention is shown. The illustrated hydraulic motor 10 is especially designed for heavy duty applications requiring low speeds and high torques. As is explained in more detail below, the motor 10 can be constructed to have an improved no-load pressure drop, a longer life expectancy, a better start-up efficiency and/or a higher torque capacity.

The motor 10 comprises an end cover 12 defining a first port 14 and a second port 16, a drive assembly 18, a shaft housing 20, a drive link 22 and a coupling shaft 24. (FIGS. 1 and 3.) In the illustrated embodiment, the end cover 12 is a separate component which functions as a rear lid for the motor 10. However, end covers integral with other components of the motor 10 and/or end covers which do not necessary perform as rear lids are possible with, and contemplated by, the present invention.

A plurality of bolts 26 (e.g, nine bolts in a circular array) extend through registered openings in the end cover 12, the drive assembly 18 and the shaft housing 20 to clamp these components together. (FIGS. 2 and 3.) In the illustrated embodiment, the motor 10 also includes a wear plate 28 positioned between the drive assembly 18 and the shaft housing 20 and the clamping bolts 26 also extend therethrough. (FIGS. 1 and 3.) Face seals 30 are provided between the end cover 12 and the drive assembly 18, between two components of the drive assembly 18 (namely a manifold 34 and a rotor set 36, introduced below), between the drive assembly 18 and the wear plate 28, and between the wear plate 28 and the shaft housing 20. (FIG. 3.)

When the motor 10 is operating in a first direction (e.g., the coupling shaft 24 rotates clockwise), the first port 14 is the inlet port and the second port 16 is the outlet port. When the motor 10 is operating in a second opposite direction (e.g., the coupling shaft 24 rotates counterclockwise), the second port 16 is the inlet port and the first port 14 is the outlet port. In either case, the inlet port can be connected to a pump discharge and the outlet port can be connected to a return line to a reservoir which feeds the pump suction. In response to pressurized fluid passing from the inlet port to the outlet port through a working fluid path, the drive assembly 18 hypocycloidally moves (i.e., orbits and rotates) the drive link 22 and the coupling shaft 24 rotates in a corresponding direction. The motor 10 does not include a case drain whereby it has a two pressure zone design.

The drive assembly 18 comprises a commutator 32, a manifold 34, and a gerotor set 36. The commutator 32 is positioned in a space between the end cover 12 and the manifold 34 for movement with the drive link 22 during operation of the motor 10. Accordingly, the illustrated commutator 32 is a fast-speed commutator which orbits at the orbiting speed of the moving member of the gerotor set 36 (namely its rotor 52, introduced below).

The commutator 32 comprises an inner ring 38, an outer ring 40, and spoke-like members extending between the rings so that the commutator's inner diameter and outer diameter can control fluid metering. The inner ring 38 captures a portion of the drive link 22 (namely its nose portion 66 introduced below). The outer ring 40 divides the space between the end cover 12 and the manifold 34 into a first chamber 42 which communicates with the first port 14 and a second chamber 44 which communicates with the second port 16.

Figure 4A:
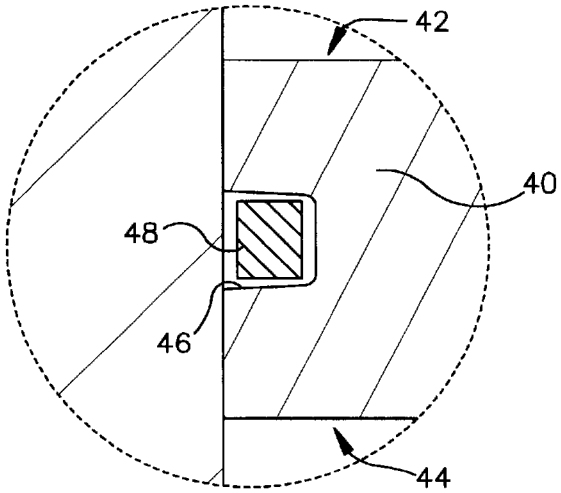
FIGS. 4A–4C are close-up sectional views of a commutator sealing arrangement.
Figure 4B:
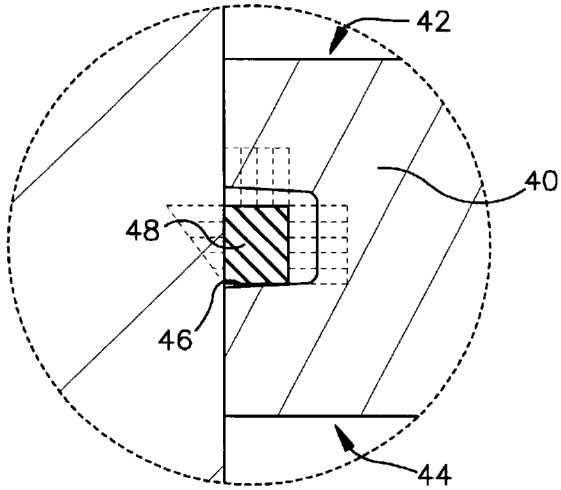
Figure 4C:
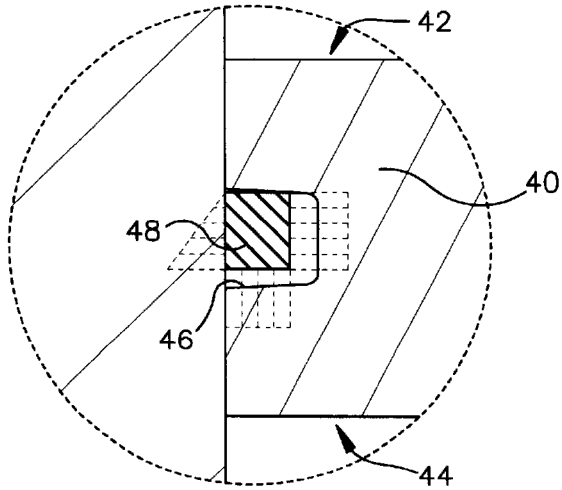

As can best be seen by referring additionally to FIGS. 4A–4C, the axial face of the outer commutator ring 40 adjacent the end cover 12 includes a groove 46 which houses a sealing ring 48. The sealing ring 48 can be made of a polyimide resin, such as VESPEL® which is a trademark of DuPont for a temperature-resistant thermosetting polyimide resin. In any event, the depth of the groove 46 is greater than the height of the sealing ring 48 whereby there will be no mechanical friction between the seal 48 and the end cover 12 at very low speed operation of the motor 10 as is found, for example, with an oversized commutator seal. This elimination of internal friction enhances the starting efficiency of the motor 10 and increases the life of the sealing ring 48.

The groove 46 and the sealing ring 48 each have substantially rectangular cross-sectional shape and the width of the groove 46 is also greater than the width of the sealing ring 48. When the motor 10 is at rest (i.e., not operating), the sealing ring 48 resides loosely within the groove 46. (FIG. 4A.) However, when the motor 10 is operating in the first direction, and high pressure fluid is introduced into the first chamber 42, the high pressure fluid presses the radially outer side of the sealing ring 48 against the radially outer side of the groove 46. Also, the imbalance between the hydraulic forces on the rear and the front of the sealing ring 48 cause it to be pushed axially rearward towards the end cover 12. (FIG. 4B.) Likewise, when the motor 10 is operating in the second direction, and high pressure fluid is introduced into the second chamber 44, the high pressure fluid presses the radially inward side of the sealing ring 48 against the radially inner side of the groove 46. Again, the imbalance between the hydraulic forces on the rear and the front of the sealing ring 48 cause it to be pushed axially rearward towards the end cover 12 (FIG. 4C.)

The manifold 34 has a first set of channels which extend between the first chamber 42 and the gerotor set 36 and a second set of channels which extend between the second chamber 44 and the gerotor set 36. The number of channels in each set and their circumferential spacing corresponds to the fluid pockets formed by the gerotor set 36 and these channels are systematically opened and closed by the commutator 32 as it is moved with the drive link 22. In the illustrated embodiment, the manifold 34 is made from a plurality of layers which are laminated together in a certain stacked arrangement to form the flow channels.

The gerotor set 36 comprises a stator 50 and a rotor 52 having different centers with a fixed eccentricity. The stator 50 has internal teeth or "vanes" which form circular arcs and the rotor 52 has one less external "teeth" or lobes. As fluid is supplied and exhausted from the fluid pockets in a timed relationship, the rotor 52 moves hypocycloidally (i.e., orbits and rotates) relative to the stator 50.

The illustrated gerotor set 36 is a 8×9 gerotor set, that is, the stator 50 has nine vanes and the rotor 52 has eight teeth, and these components cooperate to form nine fluid pockets. When compared to, for example, a 6×7 gerotor set, the 8×9 gerotor set 36 allows a larger drive link to be assembled inside the rotor 52 thereby providing a higher torque capacity. Also, the 8×9 gerotor set 36 allows a lower eccentricity (e.g., 3 mm) for a desired displacement capacity thereby providing smoother rotation of the rotor 52 and better spline engagement between the drive link 22 and the rotor 52. That being said, other gerotor designs (e.g., a 6×7 gerotor set) are possible with, and contemplated by, the present invention.

The shaft housing 20 has a central bore 54 in which the coupling shaft 24 is rotatably supported. The central bore 54 has portions of varying diameters to accommodate the stepped profile of the coupling shaft 24 as well as radial bearings 56 and thrust bearings 58. A fluid chamber 60 surrounds the coupling shaft 24 within the bore 54 and a fluid-tight seal 62 is provided to prevent leakage therefrom. A dirt seal 64 can also be provided at the exposed axial end face of the shaft housing 20.

The drive link 22 includes a nose portion 66 captured within the commutator inner ring 38, an externally splined intermediate portion 68 which mates with internal splines on the rotor 52, and an externally splined end portion 70 which mates with an internal splines on the coupling shaft 24. A fluid chamber 72, in communication with the first chamber 42, surrounds the drive link 22 as it extends through the manifold 32, the rotor 52, the wear plate 28 and into a portion (namely a sleeve portion 84 introduced below) of the coupling shaft 24. The drive link 22 also includes a passageway 74 extending between its axial ends.

Figure 5:
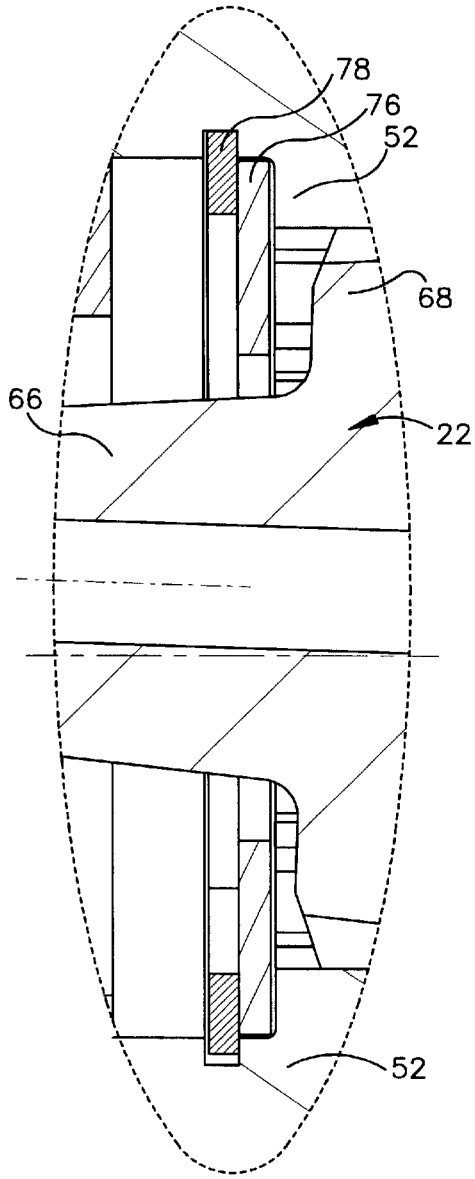
FIG. 5 is a close-up sectional view of a portion of the motor 10 showing an axial stop for limiting linear movement of a drive link.

As is best seen by referring additionally to FIG. 5, an axial stop member (e.g., a metal washer) is mounted on the rotor 52 adjacent its splined portion and held in position by a snap ring 78. The axial stop 76 has an annular shape and its inner diameter is greater than the diameter of the nose portion 66 of the drive link 22 but less than the diameter of its splined portion 68. In this manner, possible axial movement of the drive link 22 towards the end cover 12 is prevented. By mounting the axial stop 76 on a component which moves with the drive link 22, internal mechanical friction therebetween is minimized as compared to when the axial stop 76 is mounted on the end cover 12. Accordingly, the use of the inner rotor 52 as an axial stop translates into an enhancement of the motor's start-up efficiency. Also, since an axial stop does not have to be positioned in the first chamber 42, flow area within this chamber is optimized thereby further enhancing the no-load pressure drop characteristics (i.e., mechanical efficiency) of the motor 10.

The coupling shaft 24 has a rear portion 82 which projects outwardly from the shaft housing 20 and a wider front sleeve portion 84 which receives the end portion 70 of the drive link 22. The shaft 24 includes an axial passageway 86 which extends from the internal end face of the sleeve portion 84 to a radial passageway 88 communicating with the shaft-surrounding chamber 60. The chamber 72 surrounding the drive link 22 extends into the sleeve portion 84 and the shaft 24 has radial passageways 92 which connects the chamber 60 to the chamber 72.

Figure 6A:
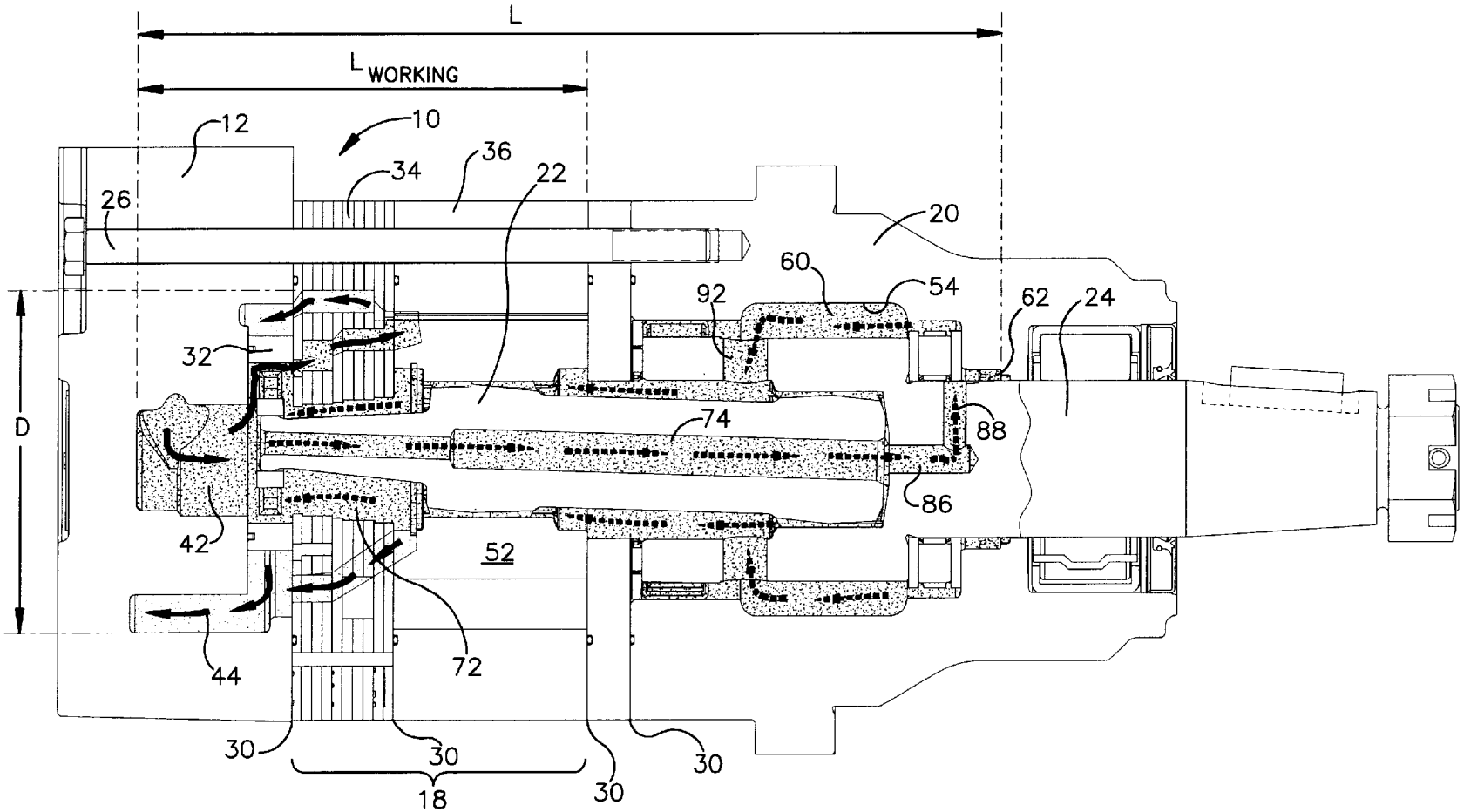
FIGS. 6A and 6B are schematic illustrations of the fluid circuit of the motor 10 when it is operating in a first direction and a second direction, respectively.
Figure 6B:
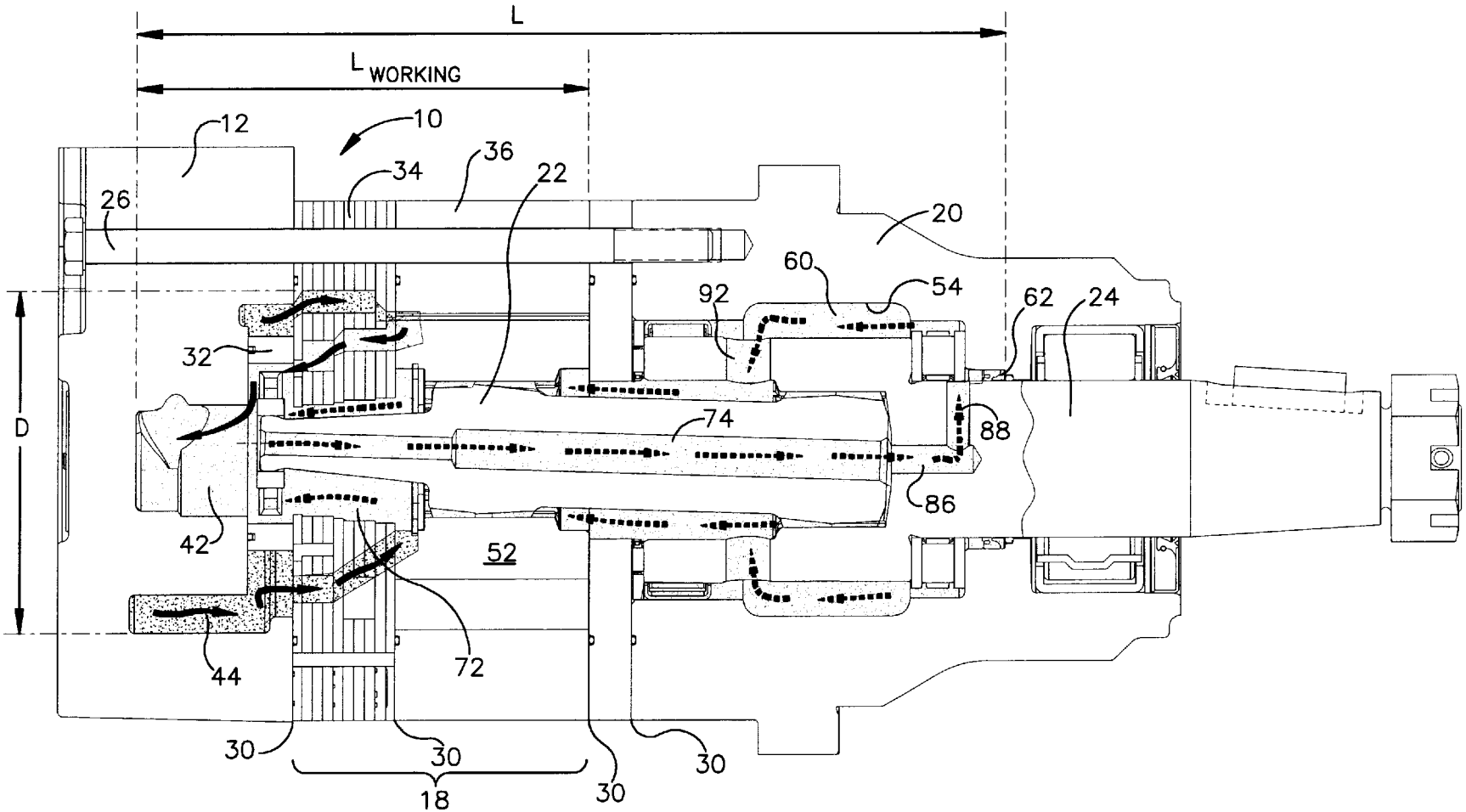

Referring now to FIGS. 6A and 6B, the fluid circuit for the motor 10 is schematically shown when the motor 10 is respectively operating in a first direction (e.g. the shaft 24 rotates clockwise) and in a second direction (e.g., the shaft 24 rotates counterclockwise). In these schematic illustrations, high pressure regions (pre-working) are represented by dark shading and low pressure regions (post-working) are represented by light shading. Also, the working path of the fluid (e.g., the path fluid follows to cause rotation of the coupling shaft 24) is represented by solid arrows and the non-working path of the fluid (e.g., the path fluid follows for cooling, lubrication and/or sealing purposes) is represented by dashed arrows.

When the motor 10 is operating in the first direction shown in FIG. 6A, high pressure fluid is introduced through the first port 14 into the first chamber 42 and the commutator 32 sequentially directs a primary portion of the high pressure fluid through the first set of flow channels in manifold 34. The manifold 34 thereby channels the high pressure fluid to the fluid pockets of the gerotor set 36 and the rotor 52 orbits/rotates in a first direction (e.g, clockwise). The now-low-pressure (post-working) fluid then flows through the second set of flow channels in the manifold 34 to the second chamber 44 and exits the motor 10 through the second port 16. (See solid arrows in FIG. 6A.)

When the motor 10 is operating in the first direction, a secondary portion of the high pressure fluid bypasses the working path and travels through the non-working path. Specifically, the secondary portion of the high pressure fluid travels through the axial passageway 74 in the drive link 22 into the axial passageway 86 in the coupling shaft 24. The rotation of the coupling shaft 24 produces centrifugal forces causing the high pressure fluid to be flung through the shaft's radial passageway 88 into the chamber 60. The fluid flows from the chamber 60, through the radial passageways 92 into the chamber 72, and back into the first chamber 42 whereat it mixes with the inlet high pressure fluid being introduced through the first port 14. (See dashed arrows in FIG. 6A.)

When the motor 10 is operating in the second direction shown in FIG. 6B, high pressure fluid is introduced through the second port 16 into the second chamber 44. The commutator 32 sequentially directs all of the high pressure fluid (i.e., none of the high pressure fluid is diverted from the working path) through the second set of flow channels in the manifold 34. The manifold 34 thereby channels the high pressure fluid to the fluid pockets of the gerotor set 36 thereby causing the rotor 52 to orbit/rotate in a second opposite direction (e.g., counterclockwise). The now-low-pressure (post-working) fluid then flows through the first set of flow channels in the manifold 34 to the first chamber 42 and a primary portion of the low pressure fluid exits the motor 10 through the first port 14. (See solid arrows in FIG. 6B.)

When the motor 10 is operating in the second direction, a secondary portion of the low pressure fluid does not exit the motor through the first port 14 but instead travels through the non-working path. Specifically, the secondary portion of the low pressure fluid travels through the drive link's axial passageway 74, into the shaft's axial passageway 86, through the shaft's radial passageway 92, into the chamber 60, through the shaft's radial passageways 92 into the chamber 72, and back into the first chamber 42 whereat it mixes with the low pressure fluid being exited through the first port 14. (See dashed arrows in FIG. 6B.)

Accordingly, when the motor 10 is operating in a first direction, the fluid flows in a first direction through the working path of the fluid circuit and, when the motor 10 is operating in a second direction, the fluid flows in a second direction through the working path of the fluid circuit. In either case, a portion of the fluid is centrifugally pumped through the non-working path in the same direction by the coupling shaft 24. When the motor 10 is operating in the first direction, the non-working portion of the fluid is diverted from the high pressure (pre-working) fluid and, when the motor 10 is operating in the second direction, the non-working portion of the fluid is diverted from the low pressure (post-worked) fluid.

As is best shown in FIGS. 6A and 6B, that the motor 10 defines a cylindrical pressure vessel having a diameter D and an axial length L. (The diameter D is defined by the outermost radial reach of the fluid circuit and the axial length is defined by the distance between the outermost axial reach of the fluid circuit.) The working portion of this pressure vessel (i.e., the portion occupied by the working path), has an axial length $L_{working}$ confined to the end cover 12 and the drive assembly 18. As such, the working fluid avoids the essentially inevitable pressure-dropping resistance it would be subjected to if the fluid traveled through non-working portions of the motor 10. This confinement of the working path results in a substantially less no-load pressure drop (e.g., 50% less) of the fluid as it travels through the working path than that found in conventional hydraulic motors which translates into a dramatic improvement in motor efficiency.

As is best seen by referring back to FIGS. 2 and 3, the clamping bolts 26 are radially positioned outside the diameter D of the motor's pressure vessel. The bolt-receiving openings do not communicate with any of the motor's fluid chambers and the face seals 30 (which define the diameter D of the pressure vessel) are located radially inward from the bolts 26.

The "dry-bolt" design of the hydraulic motor 10 results in less strain-per-bolt for a motor design having a given number of clamping bolts. Also, because fluid flow characteristics do not play a part in bolt placement considerations, more clamping bolts 26 can be used in a given motor design thereby additionally or alternatively reducing the strain-per-bolt. As the life of the clamping bolts directly influences the life of the motor, such a strain-per-bolt reduction can make a major contribution towards increasing motor life. Further, the integrity of the clamping bolts during their working life provides consistent performance regardless of whether the motor 10 is being operated in the first or second direction. Moreover, from a manufacturing point of view, this "dry bolt" design avoids the extra manufacturing cost of countersink machining which is necessary in a "wet bolt" design.

Figure 7:
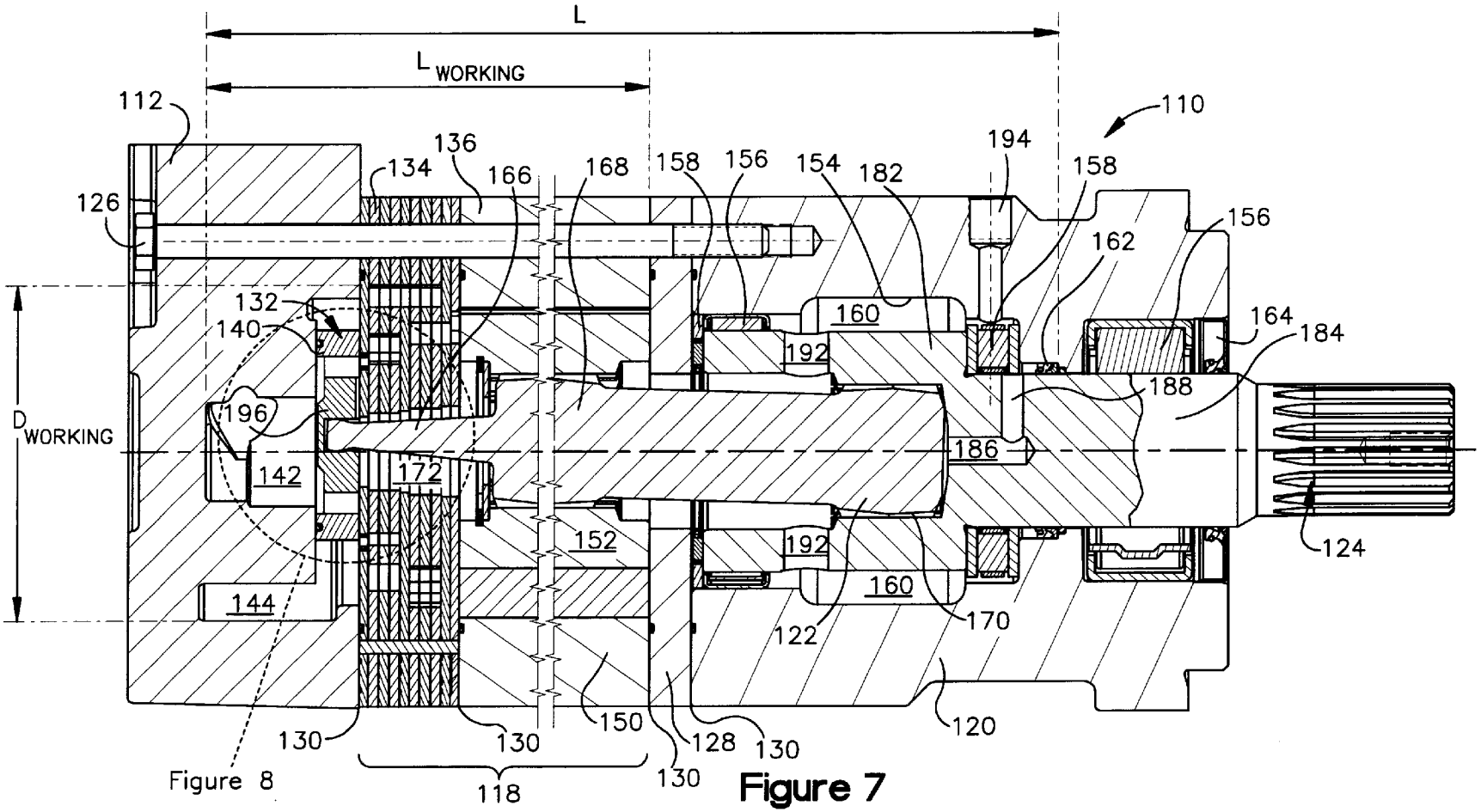
FIG. 7 is a sectional elevational view of another motor 110 according to the present invention.
Figure 8:
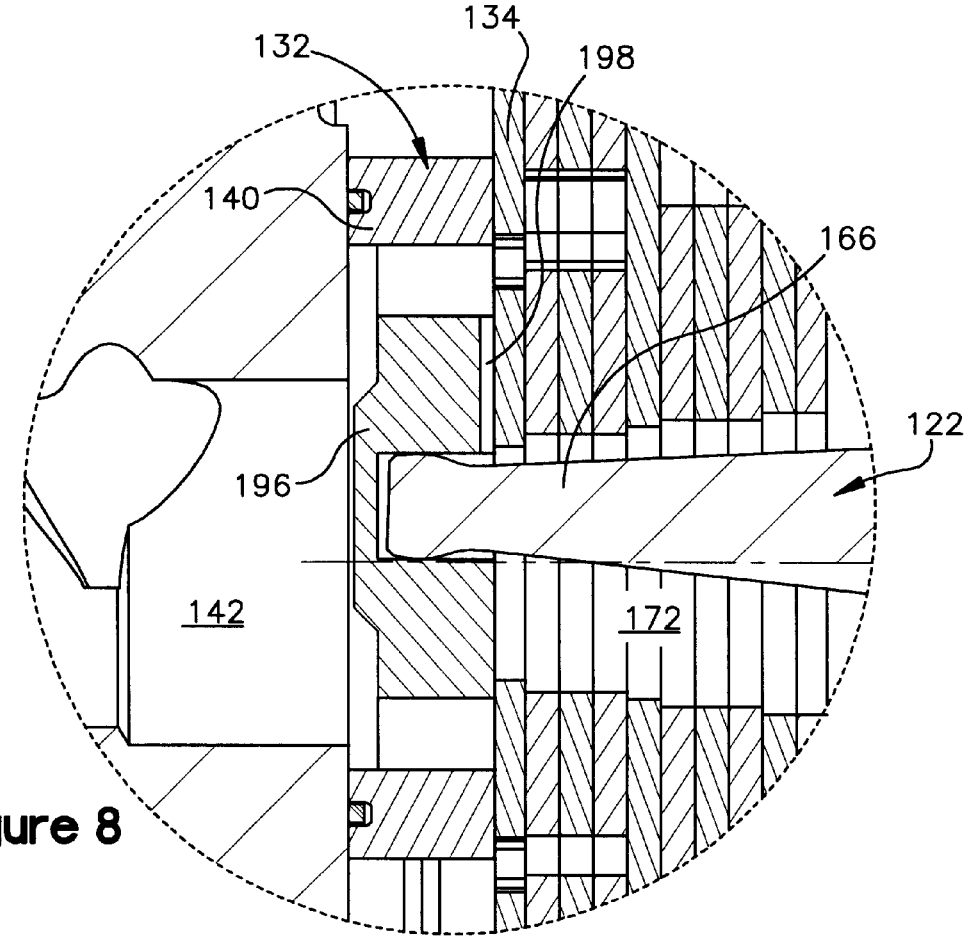
FIG. 8 is a close-up sectional view of a portion of the motor 110 showing a commutator end cap and a passageway formed therein.

Referring now to FIG. 7, another hydraulic motor 110 according to the present invention is shown. The motor 110 is similar in many ways to the motor 10 whereby like reference numerals (plus 100) are used to designate corresponding parts. It should be noted, however, that the shaft housing 120 includes a case drain 194 extending from the chamber 60 whereby the motor 110 has a three pressure zone design. Also, the drive link 122 does not include an axial passageway (although one could be provided). Further, as is best seen by referring additionally to FIG. 8, the inner commutator ring is replaced with a cap 196. The cap 196 covers the nose end 166 of the drive link 122 and separates the first chamber 142 from the chamber 172 surrounding the drive link 122, except for passageways 198 extending therebetween.

Figure 9A:
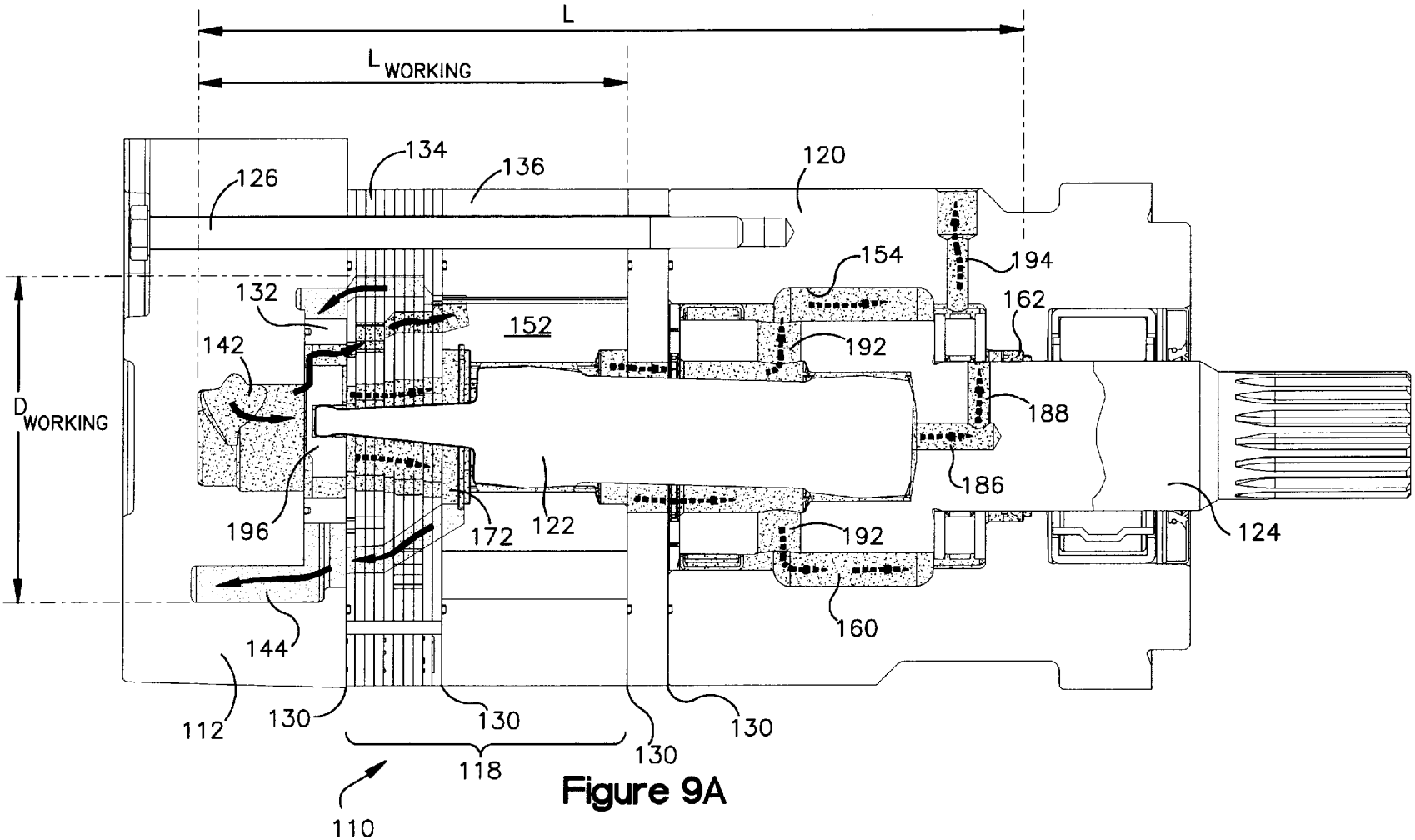
FIGS. 9A and 9B are schematic illustrations of the fluid circuit of the motor 110 when it is operating in a first direction and a second direction, respectively.
Figure 9B:
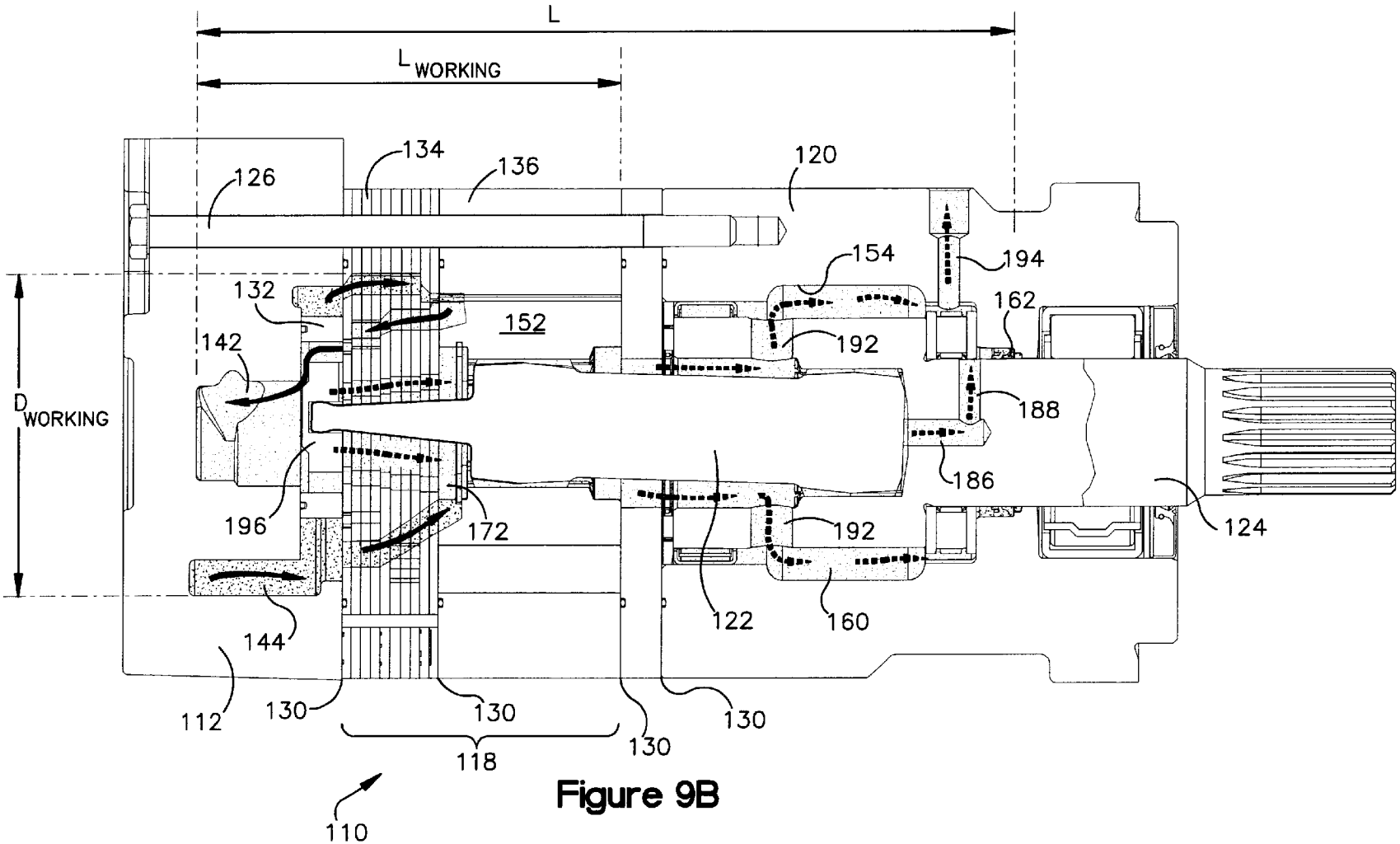

The fluid circuit for the motor 110 is schematically shown in FIGS. 9A and 9B when the motor 110 is respectively operating in a first direction (e.g. the shaft 124 rotates clockwise) and in a second direction (e.g., the shaft 124 rotates counterclockwise). As in FIGS. 6A and 6B, the high pressure regions are represented by dark shading, the low pressure regions are represented by light shading, the working path is represented by solid arrows and the non-working path is represented by dashed arrows.

The working path for the motor 110 is essentially the same as the working path for the motor 10 in the first direction and the second direction. (See solid arrows in FIGS. 9A and 9B.) Also, the working portion of the pressure vessel of the motor 110 has an axial length $L_{working}$ confined to the end cover 112 and the drive assembly 118. As with the motor 10, this confinement of the working portion of the pressure vessel significantly reduces the no-load pressure drop of the motor 110 which translates directly into an increased mechanical efficiency.

When the motor 110 is operating in the first direction (the first port 114 is the inlet port), a secondary portion of the high pressure fluid bypasses the working path and travels through the non-working path. (See dashed arrows in FIG. 9A.) When the motor 110 is operating in the second direction (the second port 116 is the inlet port), a secondary portion of the low pressure fluid bypasses the working path and travels through the non-working path. (See dashed arrows in FIG. 9B.) In either case, the non-working fluid travels from the first chamber 142 through a passageway (passageway 198 in FIG. 8) to the chamber 172 surrounding the drive link 122. Part of the non-working fluid in the chamber 172 flows through the axial passageway 186 in the coupling shaft 124, through the radial passageway 188 to the chamber 160. The rest of the working fluid in the chamber 172 flows through the radial passageway 192 in the coupling shaft 124 to the chamber 160. The non-working fluid in the chamber 160 exits the motor 110 through the case drain 194.

If the diameter of the pressure vessel for the motor 110 is defined by the outermost radial reach of the flow circuit, this would include the case drain 194. However, the clamping bolts 126 are positioned outside a pressure vessel defined by the working portion of the motor 110 (i.e., $D_{working}$ and $L_{working}$). Moreover, the flow circuit of the motor 110 does not intersect with the registered openings for the clamping members 126 and thus the motor 110 also has a "dry bolt" design with the same associated advantages as found in motor 10.

Figure 10:
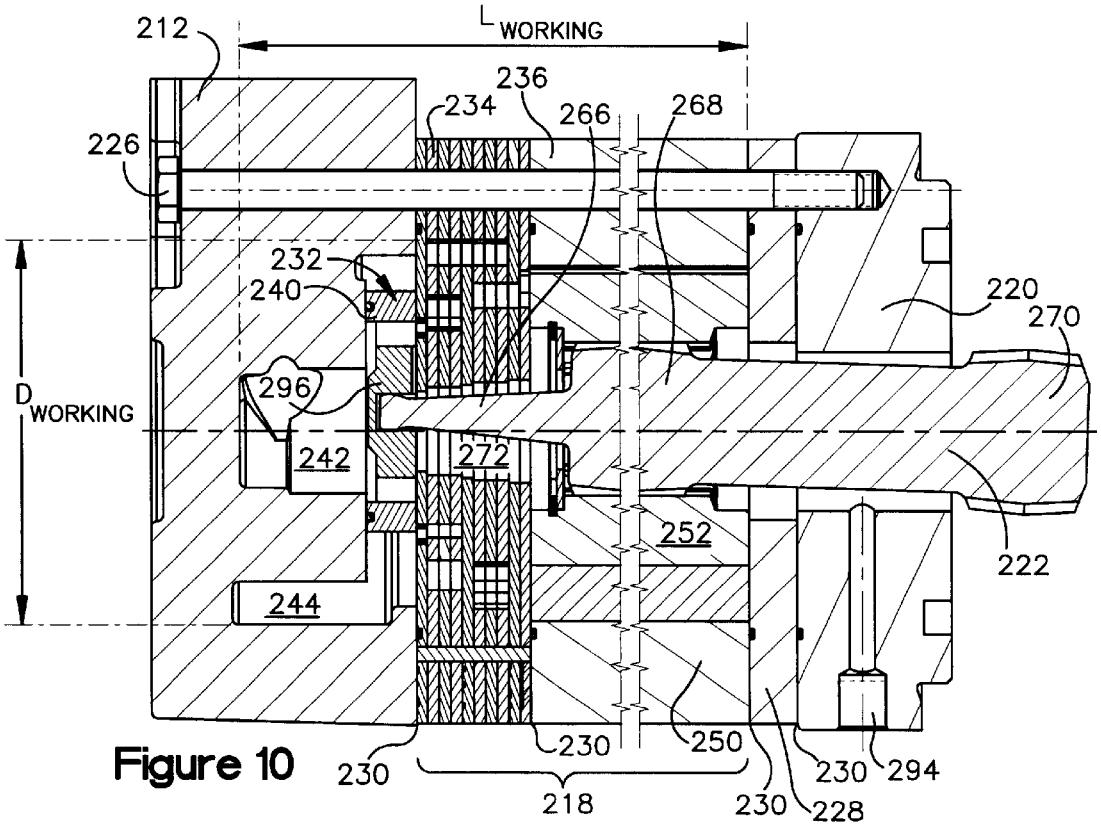
FIG. 10 is sectional elevation view of another motor 210 according to the present invention.

Referring now to FIG. 10, another hydraulic motor 210 according to the present invention is shown. The motor 210 is similar in many ways to the motor 110 whereby like reference numerals (plus 100) are used to designate corresponding parts. It should be noted, however, that in the motor 210, the drive link 222 is inserted into the gearbox of the mechanism and directly coupled to its input shaft whereby the motor 210 does not have a coupling shaft and/or a shaft housing. Accordingly, the motor 210 does not include the bearings 56/156 and 58/158 found in motors 10/110 whereby the motor 210 can be considered to be "bearingless." A mounting face housing 220 is provided for attachment to the gearbox and this housing 220 includes a case drain 294 extending from the chamber 272. Thus, the motor 210 has a three-pressure-zone design.

Figure 11:
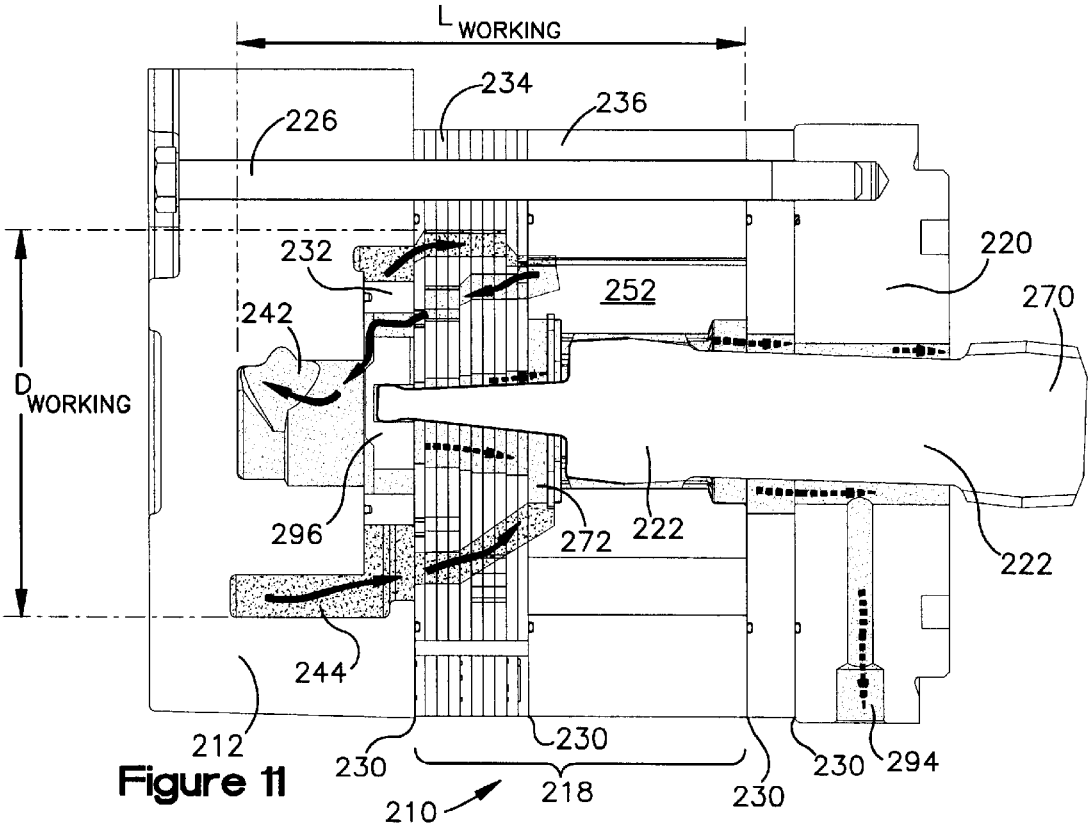
FIG. 11 is a schematic illustration of the fluid circuit of the motor 210 when it is operating in one direction.

The fluid circuit for the motor 210 is schematically shown in FIG. 11 with the high pressure regions being represented by dark shading, the low pressure regions being represented by light shading, the working path being represented by solid arrows and the non-working path being represented by dashed arrows. Since most gearboxes are not designed to accommodate high pressure lubricating/cooling fluid, the motor 210 is appropriate for unidirectional applications wherein high pressure fluid is introduced through the second port 216. Specifically, the high pressure fluid is introduced through the second port 216 and travels through the drive assembly 218 and back to the first chamber 242 as low pressure fluid and a primary portion of the low pressure fluid exits the motor through the first port 214. (See solid arrows.) A secondary portion of the low pressure fluid bypasses the working path and travels through the non-working path, that is it travels from the first chamber 242 through a passageway (see passageway 198 in FIG. 8) to the chamber 272 to the case drain 294. (See dashed arrows.)

The working portion of the pressure vessel of the motor 210 has an axial length $L_{working}$ confined to the end cover 212 and the drive assembly 218 and, as with the motors 10 and 110, this confinement significantly reduces no-load pressure drops. Also, the clamping bolts 226 are positioned outside a pressure vessel defined by the working portion of the motor 110 (i.e., $D_{working}$ and $L_{working}$) and the motor's flow circuit does not intersect with the registered openings for the clamping members 226. Thus, the motor 210 also has a "dry bolt" design with the same associated advantages as found in motors 10 and 110.

One can now appreciate that a hydraulic motor 10/110/210 according to the present invention can provide decreased no-load pressure losses, an extended life expectancy, an enhanced start-up efficiency, and/or an increased torque capacity. It should be noted that while the illustrated motor 10 was designed for heavy duty applications requiring low speed and high torque, the principals of the invention can be employed in motors designed for other applications. It should also be noted that while the various aspects of the invention have been described as being incorporated into the same motor design, these aspects could be used separately and/or in different combination in a plurality of motor designs. By way of an example, the valve interface sealing arrangement can be used on a fast-speed commutator (as shown), a slow-speed commutator or, for that matter, in a variety of valve interface settings to prevent friction during start-up and/or very low speed operation. By way of another example, the rotor-mounted axial stop system could be utilized in many other motor designs to limit internal mechanical friction upon engagement of the drive link with the axial stop. By way of a further example, a drive link with an axial passageway could be used in certain three-pressure-zone motor designs. Accordingly, although the invention has been shown and described with respect to certain preferred embodiments, it is obvious that equivalent and obvious alterations and modifications will occur to others skilled in the art upon the reading and understanding of this specification.

I claim:

1. A hydraulic motor comprising:

an end cover, which includes a first port and a second port;

a drive link;

a drive assembly;

a flow circuit between the first port and the second port;

a coupling shaft, which is connected to the drive link;

a shaft housing, which rotatably supports the coupling shaft; and a plurality of clamping members extending through registered openings in the end cover, the drive assembly, and the shaft housing to clamp them together;

wherein the flow circuit comprises a working path that causes the drive assembly to hypocycloidally move the drive link in a first direction when fluid passes from the first port to the second port through the working path, and that causes the drive assembly to hypocycloidally move the drive link in a second opposite direction when fluid passes from the second port to the first port through the working path; and wherein the working path is axially confined to a length substantially between the end cover and the drive assembly;

wherein the flow circuit defines a cylindrical pressure vessel containing the working path;

wherein the clamping members are positioned outside of the pressure vessel;

wherein a sealing ring seals an interface between the end cover and a movable member of the drive assembly, the member has a groove in which the sealing ring is positioned, the sealing ring has a cross-sectional shape, and the groove has a cross-sectional shape larger than the cross-sectional shape of the sealing ring whereby the sealing ring is movable within the groove in response to fluid pressure;

wherein an axial stop for the drive link is positioned within a part of the drive assembly which moves with the drive link; and wherein the flow circuit also comprises a non-working path passing through a chamber surrounding the drive link and wherein:

a coupling shaft centrifugally pumps a diverted portion of fluid from the working path through the non-working path back to the working path; or the housing includes a case drain at the end of the non-working path.

2. A hydraulic motor as set forth in claim 1, wherein the plurality of clamping members comprises a circular array of bolts.

3. A hydraulic motor as set forth in claim 1, wherein the coupling shaft is connected to the drive link, and a shaft housing rotatably supports the coupling shaft; and wherein the non-working path passes through a chamber surrounding the coupling shaft; and wherein the coupling shaft centrifugally pumps a diverted portion of fluid from the working path through the non-working path.

4. A hydraulic motor as set forth in claim 1, wherein the coupling shaft is connected to the drive link, and a shaft housing rotatably supports the coupling shaft;

wherein the non-working path also passes through a chamber surrounding the coupling shaft; and wherein the non-working path comprises an axial passageway in the drive link.

5. A hydraulic motor as set forth in claim 1, wherein the non-working path exits through a case drain.

6. A hydraulic motor as set forth in claim 1, further comprising a sealing ring which seals an interface between the end cover and a movable member of the drive assembly;

wherein the member has a groove in which the sealing ring is positioned; and wherein the sealing ring has a cross-sectional shape with a height and a width and the groove has a cross-sectional shaping with a depth and a width; and wherein the height of the sealing ring is less than the depth of the groove.

7. A hydraulic motor as set forth in claim 6, wherein the width of the sealing ring is less than the width of the groove whereby the sealing ring is movable within the groove in response to fluid pressure.

8. A hydraulic motor as set forth in claim 7, wherein the cross-sectional shape of the sealing ring is roughly rectangular and wherein the cross-sectional shape of the groove is also roughly rectangular.

9. A hydraulic motor comprising an end cover, a drive link, a drive assembly, a housing, and a plurality of clamping members, and wherein:

the end cover, the drive assembly, the drive link, and the housing define a first port, a second port and a flow circuit therebetween;

the plurality of clamping members extend through registered openings in the end cover, the drive assembly, and the housing to clamp them together;

the flow circuit is contained within a cylindrical pressure vessel, and the plurality of clamping members are positioned outside of the pressure vessel;

a sealing ring seals an interface between the end cover and a movable member of the drive assembly, the member has a groove in which the sealing ring is positioned, and the sealing ring has a cross-sectional shape smaller than a cross-sectional shape of the groove whereby the sealing ring is movable within the groove in response to fluid pressure;

an axial stop for the drive link is positioned within a part of the drive assembly which moves with the drive link; and the flow circuit also comprises a non-working path passing through a chamber surrounding the drive link and wherein:

a coupling shaft centrifugally pumps a diverted portion of fluid from the working path through the non-working path back to the working path; or the housing includes a case drain at the end of the non-working path.

10. A hydraulic motor as set forth in claim 9, wherein the plurality of clamping members comprise a circular array of bolts.

11. A hydraulic motor as set forth in claim 9, wherein the non-working path comprises an axial passageway in the drive link.

12. A hydraulic motor as set forth in claim 9, wherein the housing includes a case drain at an end of the non-working path.

13. A hydraulic motor comprising an end cover, a drive link, a drive assembly, and flow circuit between a first port and a second port;

the drive assembly comprises a rotor which moves to expel and admit fluid to fluid pockets, a manifold which has channels extending between the ports and the fluid pockets, and a commutator which systemically opens and closes these channels;

the drive link includes a nose portion captured by the commutator and an intermediate portion connected to the rotor for movement therewith;

an axial stop for the drive link is mounted on the rotor and moves therewith during operation of the motor; and the axial stop member has an annular shape with an inner diameter greater than the nose portion of the drive link but less than its intermediate portion.

14. A hydraulic motor comprising an end cover, a drive link, a drive assembly, an coupling shaft which is connected to the drive link, and a shaft housing which rotatably supports the coupling shaft, and wherein:

the end cover, the drive assembly, the drive link, the coupling shaft, and the shaft housing define a first port, a second port, and a flow circuit therebetween;

the flow circuit comprises a working path that causes the drive assembly to hypocycloidally move the drive link in a first direction when fluid passes from the first port to the second port through the working path, and that causes the drive assembly to hypocycloidally move the drive link in a second opposite direction when fluid passes from the second port to the first port through the working path;

the flow circuit also comprises a non-working path passing through chambers surrounding the drive link and the coupling shaft; and the coupling shaft centrifugally pumps a diverted portion of fluid from the working path through the non-working path;

the diverted portion of the fluid for the non-working path is diverted prior to the working path when the motor is operating in the first direction, and wherein the diverted portion of the fluid for the non-working path is diverted after the working path when the motor is operating in the second direction;

when the motor is operating in the first direction and when the motor is operating in the second direction, the diverted portion of the fluid is pumped through the non-working path in the same direction;

the non-working path comprises an axial passageway through the drive link;

the end cover includes the first port and the second port and wherein the working path is axially confined to a length between the end cover and the drive assembly;

clamping members extend through registered openings in the end cover, the drive assembly, and the shaft housing to clamp them together, the flow circuit defines a cylindrical pressure vessel containing both the working path, and the clamping members are positioned outside of the pressure vessel;

a sealing ring seals an interface between the end cover and a movable member of the drive assembly, the member has a groove in which the sealing ring is positioned, and the sealing ring has a cross-sectional shape and wherein the groove has a cross-sectional shape larger than the cross-sectional shape of the sealing ring whereby the sealing ring is movable within the groove in response to fluid pressure; and an axial stop for the drive link is positioned within a part of the drive assembly which moves with the drive link.

15. A hydraulic motor comprising an end cover which includes a first port and a second port, a drive link, a drive assembly, an coupling shaft which is connected to the drive link, and a shaft housing which rotatably supports the coupling shaft, and wherein:

the end cover, the drive assembly, the drive link, the coupling shaft, and the shaft housing define a flow circuit therebetween;

the flow circuit comprises a working path that causes the drive assembly to hypocycloidally move the drive link in a first direction when fluid passes from the first port to the second port through the working path, and that causes the drive assembly to hypocycloidally move the drive link in a second opposite direction when fluid passes from the second port to the first port through the working path;

the working path is axially confined to a length between the end cover and the drive assembly;

the flow circuit also comprises a non-working path passing through chambers surrounding the drive link and the coupling shaft, and the coupling shaft centrifugally pumps a diverted portion of fluid from the working path through the non-working path;

a sealing ring seals an interface between the end cover and a movable member of the drive assembly, the member has a groove in which the sealing ring is positioned, and the sealing ring has a cross-sectional shape and wherein the groove has a cross-sectional shape larger than the cross-sectional shape of the sealing ring whereby the sealing ring is movable within the groove in response to fluid pressure; and an axial stop for the drive link is positioned within a part of the drive assembly which moves with the drive link.

* * * * *